US011096532B2

(12) United States Patent
Abe et al.

(10) Patent No.: US 11,096,532 B2
(45) Date of Patent: Aug. 24, 2021

(54) VACUUM CLEANER

(71) Applicant: Toshiba Lifestyle Products & Services Corporation, Kawasaki (JP)

(72) Inventors: Yusuke Abe, Kasugai (JP); Yukio Machida, Owariasahi (JP); Fumiki Mano, Hatano (JP); Naoko Shinagawa, Owariasahi (JP); Takayoshi Shimizu, Kasugai (JP)

(73) Assignee: Toshiba Lifestyle Products & Services Corporation, Kawasaki (JP)

( * ) Notice: Subject to any disclaimer, the term of this patent is extended or adjusted under 35 U.S.C. 154(b) by 259 days.

(21) Appl. No.: 16/257,509

(22) Filed: Jan. 25, 2019

(65) Prior Publication Data

US 2019/0150685 A1 May 23, 2019

Related U.S. Application Data

(63) Continuation of application No. PCT/JP2017/027063, filed on Jul. 26, 2017.

(30) Foreign Application Priority Data

Jul. 28, 2016 (JP) ..... JP2016-148828

(51) Int. Cl.

| | |
|---|---|
| ***A47L 5/32*** | (2006.01) |
| ***A47L 9/28*** | (2006.01) |
| ***A47L 9/22*** | (2006.01) |
| ***A47L 9/32*** | (2006.01) |

(Continued)

(52) U.S. Cl.
CPC *A47L 5/32* (2013.01); *A47L 9/16* (2013.01); *A47L 9/22* (2013.01); *A47L 9/28* (2013.01); *A47L 9/2884* (2013.01); *A47L 9/32* (2013.01); *A47L 5/24* (2013.01)

(58) Field of Classification Search
CPC ... A47L 5/225; A47L 5/24; A47L 5/26; A47L 5/32; A47L 9/16; A47L 9/22; A47L 9/28; A47L 9/2884; A47L 9/32; A47L 9/322
See application file for complete search history.

(56) References Cited

U.S. PATENT DOCUMENTS

| | | | | |
|---|---|---|---|---|
| 9,433,332 | B2 * | 9/2016 | Conrad | A47L 5/362 |
| 2014/0234130 | A1 * | 8/2014 | Yamaoka | A01G 20/47 417/234 |

(Continued)

FOREIGN PATENT DOCUMENTS

| | | |
|---|---|---|
| DE | 10 2012 100 049 A1 | 7/2013 |
| JP | 2004-41760 | 2/2004 |
| JP | 2005-110714 | 4/2005 |

(Continued)

OTHER PUBLICATIONS

JP-2015144785-A—English Machine Translation (Year: 2015).*
International Search Report dated Sep. 5, 2017 in PCT/JP2017/027063, filed on Jul. 26, 2017.

*Primary Examiner* — Marc Carlson
(74) *Attorney, Agent, or Firm* — Oblon, McClelland, Maier & Neustadt, L.L.P.

(57) ABSTRACT

A vacuum cleaner is provided with a cleaner main body having an electric blower and a handle. The handle is shaped such that a gravity center position of the cleaner main body remains substantially unchanged in a state in which any one region is gripped.

6 Claims, 3 Drawing Sheets

(51) Int. Cl.
*A47L 9/16* (2006.01)
*A47L 5/24* (2006.01)

(56) References Cited

U.S. PATENT DOCUMENTS

| | | | | |
|---|---|---|---|---|
| 2015/0000070 | A1 | 1/2015 | Liu et al. | |
| 2017/0258282 | A1* | 9/2017 | Shinagawa | A47L 9/2857 |

FOREIGN PATENT DOCUMENTS

| | | | | |
|---|---|---|---|---|
| JP | 2015-144785 | | | 8/2015 |
| JP | 2015-144785 | A | | 8/2015 |
| JP | 2015144785 | A | * | 8/2015 |
| JP | 2016-67729 | | | 5/2016 |
| JP | 2016-123746 | A | | 7/2016 |
| JP | 2016-123747 | | | 7/2016 |
| JP | 2016-123747 | A | | 7/2016 |

* cited by examiner

VACUUM CLEANER

CROSS-REFERENCE TO RELATED APPLICATIONS

This application is based upon and claims the benefit of priority from the prior Japanese Patent Application No. 2016-148828 filed on Jul. 28, 2016, the entire contents of which are herein incorporated by reference.

FIELD

Embodiments of the present invention relate to a vacuum cleaner provided with a cleaner main body having a handle.

BACKGROUND

Conventionally, a handy (portable vacuum cleaner has a layout design in which components inside a cleaner main body are close to each other to attain compactness.

In the case, the position of a handle is disposed outside the internal components, and the cleaner main body tends to tilt so that operability is easy to be deteriorated when the handle is gripped. Accordingly, a vacuum cleaner which ensures operability in a handle-gripped state is desired.

DETAILED DESCRIPTION

According to one embodiment, a vacuum cleaner is provided with a cleaner main body having an electric blower and a handle. The handle is shaped such that a gravity center position of the cleaner main body in a use state remains substantially unchanged in a state in which any one region is gripped.

Hereinafter, a further embodiment will be described with reference to FIGS. 1 to 3.

Figure 2:
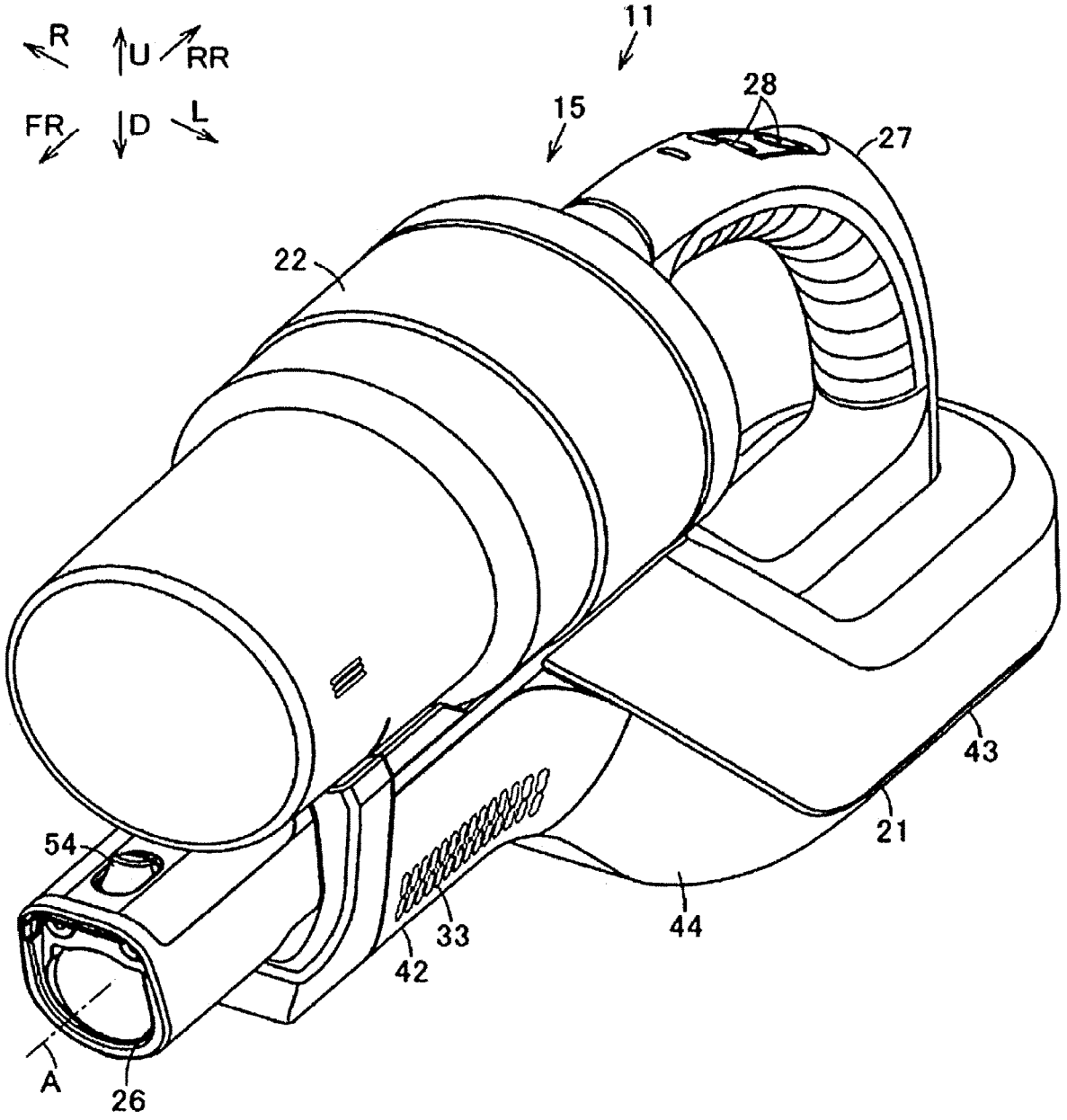
FIG. 2 is a perspective view of the vacuum cleaner in the one use state.
Figure 3:
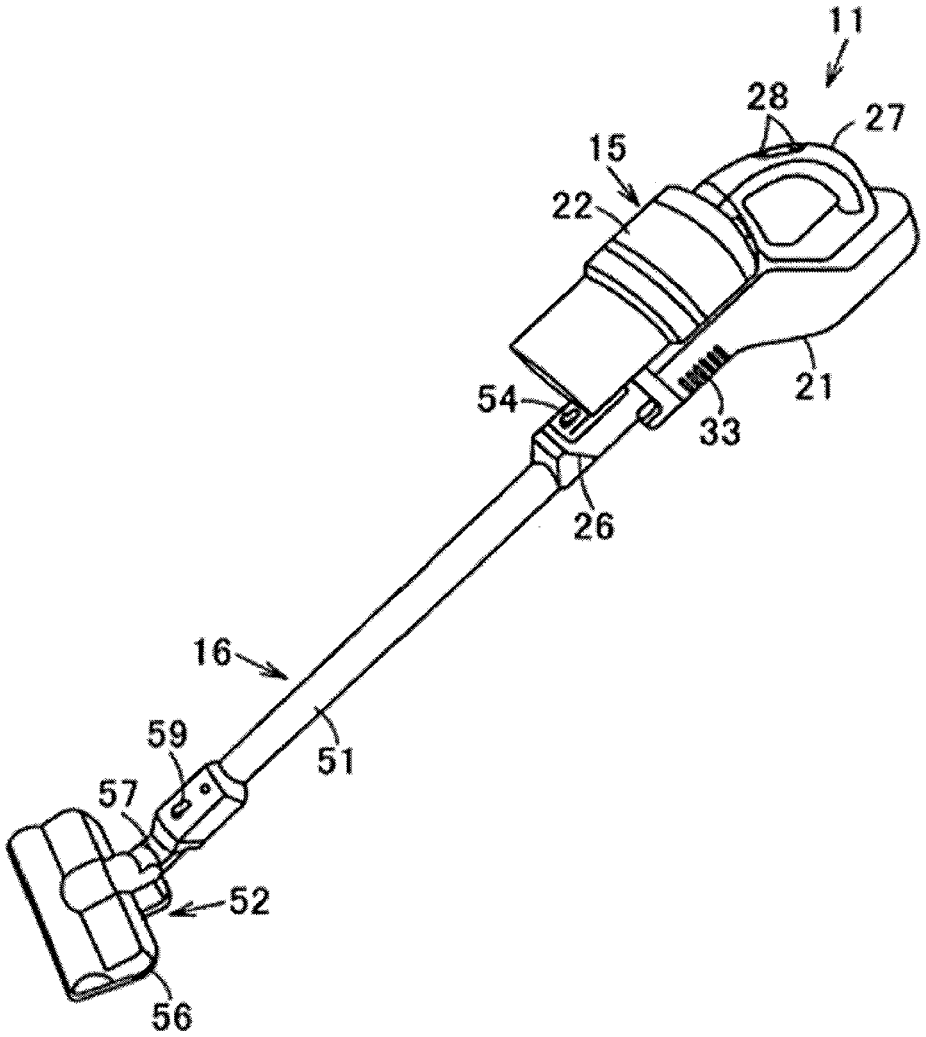
FIG. 3 is a perspective view illustrating another use state of the vacuum cleaner.

In FIG. 3, 11 denotes a vacuum cleaner. The vacuum cleaner 11 is provided with a cleaner main body 15. The vacuum cleaner 11 may be provided with an elongated air duct body 16 connected to the cleaner main body 15. The vacuum cleaner 11 is used as a handy (portable) cordless vacuum cleaner in a predetermined use state only with the cleaner main body 15, i.e., in the one use state (FIGS. 1 and 2) which is a predetermined use state where the air duct body 16 is removed from the cleaner main body 15.

In a case where the vacuum cleaner 11 is provided with the air duct body 16, the vacuum cleaner 11 can be used as a stick-type cordless vacuum cleaner in another use state (FIG. 3) where the air duct body 16 is connected to the cleaner main body 15. The vacuum cleaner 11 may constitute an electric cleaning device together with a storage device (not illustrated) for storing the vacuum cleaner 11 when the vacuum cleaner 11 is not used.

Figure 1:
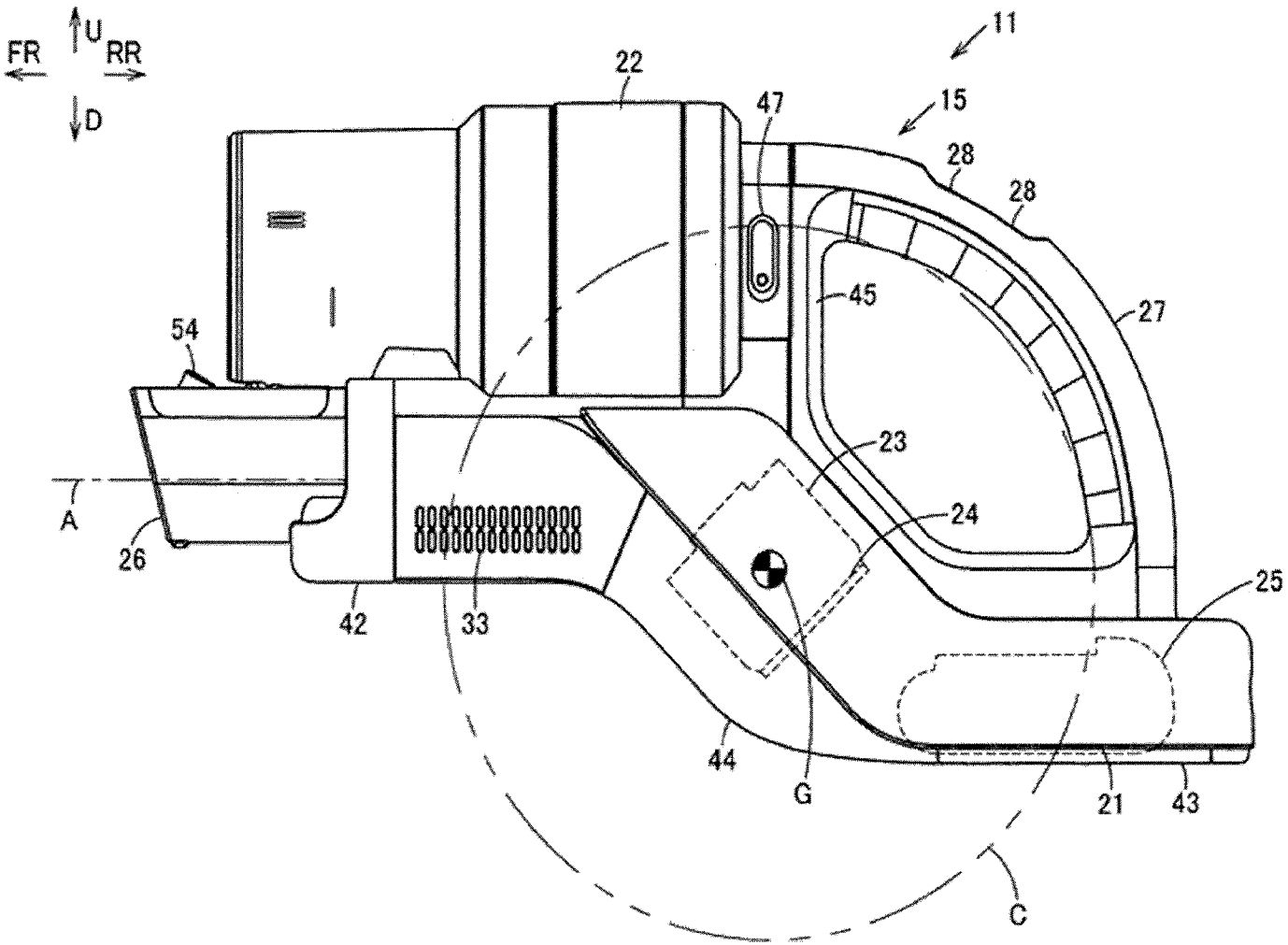
FIG. 1 is a side view illustrating one use state of a vacuum cleaner according to an embodiment.

The cleaner main body 15 illustrated in FIGS. 1 to 3 is provided with a main body portion 21. The cleaner main body 15 is provided with a dust collecting unit (dust collecting device) 22 detachable from the main body portion 21. Further, the cleaner main body 15 is provided with an electric blower 23. The cleaner main body 15 is provided with control device (control unit) 24 for controlling the operation of the electric blower 23. Further, the cleaner main body 15 is provided with a secondary battery 25, which is a battery serving as a power supply unit supplying electric power to the electric blower 23, the control device 24 etc. The cleaner main body 15 is provided with a main body connection port 26 allowing the air duct body 16 to be connected. Further, the cleaner main body 15 is provided with a handle (gripping portion) 27, which is a main body holding portion as a human body contact portion for holding the cleaner main body 15 (vacuum cleaner 11). The cleaner main body 15 is provided with a setting button 28 as setting device for setting an operation mode of the electric blower 23. The cleaner main body 15 is provided with a first communication port (not illustrated) and a second communication port (not illustrated) on the surface of the main body portion 21. Each of the first communication port and the second communication port communicates with the dust collecting unit 22. Further, the cleaner main body 15 is provided with an exhaust port 33 discharging the exhaust of the electric blower 23. An air duct is formed in the cleaner main body 15 such that the main body connection port 26 and the first communication port communicate with each other, the second communication port and the suction side of the electric blower 23 communicate with each other, and the exhaust side of the electric blower 23 and the exhaust port 33 communicate with each other.

The vacuum cleaner 11 has a state illustrated in FIG. 2 or 3, in which an axis A of the main body connection port 26 is inclined downwards, as a use state. In the following description, a direction substantially parallel to the axis A of the main body connection port 26 is defined as a forward-rearward direction, and an upward-downward direction and a leftward-rightward directions are defined with reference to the forward-rearward direction, in order that the description can be further clarified. In other words, as for the upward-downward direction, the leftward-rightward direction and the forward-rearward direction of the vacuum cleaner 11, an arrow U direction is defined as the upward direction, an arrow D direction is defined as the downward direction, an arrow FR direction is defined as the forward direction, an arrow RR direction is defined as the rearward direction, an arrow L (FIG. 2) direction is defined as the leftward direction, and an arrow R (FIG. 2) direction is defined as the rightward direction, with reference to the state illustrated in FIG. 1.

The main body portion 21 is illustrated in FIGS. 1 to 3. The main body portion 21 as a whole is formed in an elongated shape in the forward-rearward direction. The main body portion 21 accommodates each of the electric blower 23, the control device 24, and the secondary battery 25. The main body connection port 26 is open in the main body portion 21. Further, the handle 27 protrudes from the main body portion 21. The first communication port and the second communication port are open in the main body portion 21. Further, the exhaust port 33 is open in the main body portion 21. The main body portion 21 is provided with a first main body portion 42 positioned in the front portion and extending along the forward-rearward direction, a second main body portion 43 positioned in the rear portion and extending along the forward-rearward direction, and an inclined main body portion 44 as a connecting main body portion interconnecting the first main body portion 42 and the second main body portion 43. The main body portion 21 is provided with an attachment holding portion 45 where the dust collecting unit 22 is attached and held.

The first main body portion 42 is formed in a substantially linear shape along the forward-rearward direction. The first main body portion 42 is positioned on the axis A of the main body connection port 26. The second main body portion 43 is positioned below the first main body portion 42. In other words, the second main body portion 43 is positioned below the axis A of the main body connection port 26. The second main body portion 43 is linearly formed along the forward-rearward direction. Accordingly, the second main body portion 43 is substantially formed in parallel to the first main body portion 42. Further, the inclined main body portion 44 is formed along a straight line inclined from the upper front side to the lower rear side. Accordingly, the main body portion 21 is formed so as to be bent in a substantially crank shape.

The attachment holding portion 45 protrudes upwards from the upper portion of the first main body portion 42 i.e. the position where the first main body portion 42 and the inclined main body portion 44 are continuous (near a bending position). For example, the attachment holding portion 45 has a surface linearly formed along the upward-downward direction. Accordingly, the attachment holding portion 45 extends along a direction intersecting with the longitudinal direction of the cleaner main body 15 (the main body portion 21). The attachment holding portion 45 is positioned above the axis A of the main body connection port 26.

The dust collecting unit 22 communicates with the suction side of the electric blower 23. The dust collecting unit 22 collects dust suctioned as a result of the operation of the electric blower 23. The dust collecting unit 22 is, for example, a dust collecting cup of a cyclone separation-type which centrifugally separates (cyclonically separates) dust suctioned with air as a result of the operation of the electric blower 23 from the air. The dust collecting unit 22 is the heaviest object in the vacuum cleaner 11. In other words, the dust collecting unit 22 is a heavy object approximately equal in weight to the secondary battery 25. The dust collecting unit 22 is detachable from the upper portion of the main body portion 21 (the first main body portion 42). In other words, the dust collecting unit 22 is positioned on the front side of the vacuum cleaner 11. Further, the dust collecting unit 22 is provided with a dust collecting locking portion 47 for locking the dust collecting unit 22 to the main body portion 21. In the embodiment, the dust collecting locking portion 47 is provided, for example, in an end portion of the dust collecting unit 22. Alternatively, the dust collecting locking portion 47 may be provided on the main body portion 21 side. In the embodiment, the dust collecting locking portion 47 is locked and held by the attachment holding portion 45. The dust collecting unit 22 is positioned above the axis A of the main body connection port 26. Further, the dust collecting unit 22 is positioned above and in front of a gravity center position G of the cleaner main body 15. The dust collecting unit 22 is provided with a dust collecting suction port (not illustrated) and a dust collecting exhaust port (not illustrated). The dust collecting suction port and the dust collecting exhaust port communicate with the first communication port and the second communication port in a state where the dust collecting unit 22 is attached to the main body portion 21. Accordingly, the dust collecting unit 22 communicates with the suction side of the electric blower 23 in a state of being attached to the main body portion 21. The dust collecting unit 22 is connected to the downstream side of the main body connection port 26 (or the air duct body 16) in a state of being attached to the main body portion 21.

The electric blower 23 is provided with an electric motor and a fan rotated by the electric motor. A brushless motor, for example, is used as the electric motor. The electric blower 23 is accommodated in the inclined main body portion 44. For example, the electric blower 23 is accommodated along the inclined main body portion 44, in other words, in a state of being inclined upwards and downwards with respect to the forward-rearward direction. Accordingly, the electric blower 23 is positioned in the substantially middle portion of the cleaner main body 15 (the main body portion 21) in the forward-rearward direction (the longitudinal direction). For example, the electric blower 23 is partially positioned at a position overlapping with the axis A of the main body connection port 26. The gravity center position of the electric blower 23 substantially coincides with the gravity center position G of the cleaner main body 15 (in a state where the dust collecting unit 22 is attached to the main body portion 21).

The control device 24 is a control board provided with a microcomputer, for example. The control device 24 is provided with a drive control unit operating the electric blower 23, for example, in accordance with user setting based on the setting button 28. The control device 24 may be provided with a charging circuit portion such as a constant current circuit for charging the secondary battery 25 by receiving electric power supply from an external power supply such as a commercial AC power supply. The control device 24 is accommodated on the rear side of the electric blower 23 in the inclined main body portion 44. The control device 24 is positioned below the axis A of the main body connection port 26. In other words, the control device 24 is positioned on the side opposite to the dust collecting unit 22 with respect to the axis A of the main body connection port 26. The control device 24 is positioned below the gravity center position G of the cleaner main body 15.

The secondary battery 25 is, for example, a battery pack provided with batteries. The weight of the secondary battery 25 exceeds the weight of the electric blower 23. The secondary battery 25 is the heaviest object in the vacuum cleaner 11. The secondary battery 25 is accommodated in the second main body portion 43. For example, the secondary battery 25 is disposed in the forward-rearward direction along the second main body portion 43. Accordingly, the secondary battery 25 is positioned behind the electric blower 23 (and the control device 24). In other words, the secondary battery 25 is positioned on the rear side of the cleaner main body 15 (the main body portion 21). The secondary battery 25 is positioned below the axis A of the main body connection port 26. The secondary battery 25 is positioned on the side opposite to the dust collecting unit 22 with respect to the axis A of the main body connection port 26. The dust collecting unit 22 and the secondary battery 25 are positioned above and below across the axis A of the main body connection port 26. The secondary battery 25 is positioned behind and below the gravity center position G of the cleaner main body 15. Accordingly, the secondary battery 25 and the dust collecting unit 22 are disposed on both front and rear sides across the gravity center position G of the cleaner main body 15. The electric blower 23 is disposed between the secondary battery 25 and the dust collecting unit 22.

The main body connection port 26 is a suction port when the vacuum cleaner 11 is used as a handy cleaner. The main body connection port 26 is a communication port which allows the air duct body 16 and the cleaner main body 15 to communicate with each other when the vacuum cleaner 11 is used as a stick-type cleaner.

The handle 27 is positioned in the upper portion of the cleaner main body 15 (the main body portion 21). The handle 27 is positioned near the rear portion of the cleaner main body 15 (the main body portion 21). For example, the handle 27 interconnects the attachment holding portion 45 and the second main body portion 43 of the main body portion 21 and is positioned along the forward-rearward direction. The handle 27 is positioned so as to interconnect the upper end portion of the attachment holding portion 45 and the rear end portion of the second main body portion 43. The handle 27 is provided at a position which connects the dust collecting unit 22 and the secondary battery 25 of the cleaner main body 15. Accordingly, the handle 27 is positioned behind the dust collecting unit 22. The handle 27 is positioned above the secondary battery 25. Further, the handle 27 is formed approximately along an arc C which is centered at the gravity center position G of the cleaner main body 15 substantially (substantially along an arc). The handle 27 is formed such that respective positions are equally distant substantially from the gravity center position G of the cleaner main body 15 (the gravity center position of the electric blower 23). The handle 27 is shaped such that the gravity center position G of the cleaner main body 15 remains substantially unchanged in a state in which any one region is gripped. The gravity center position G of the cleaner main body 15 is positioned slightly below the axis A of the main body connection port 26. For example, the handle 27 is formed so as to be curved gradually downwards from the front side to the rear side. In the embodiment, the handle 27 is positioned rearwards from above and over a range of approximately 90° about the gravity center position G of the cleaner main body 15. Further, the handle 27 is disposed at a position intersecting with the axis A of the main body connection port 26. One end (a front end) of the handle 27 is positioned above the axis A and the other end (a rear end) of the handle 27 is positioned below the axis A. The setting button 28 is disposed in the upper portion of the handle 27.

The setting button 28 is positioned near the front side of the handle 27, for example. Accordingly, the setting button 28 is positioned above the axis A of the main body connection port 26. The setting button 28 is positioned above and behind the gravity center position G of the cleaner main body 15. A user gripping the handle 27 can push the setting button 28 with the thumb etc. of his hand which grips the handle 27.

The first communication port is positioned in the upper portion of the first main body portion 42. Similarly, the second communication port is positioned in the upper portion of the first main body portion 42. Accordingly, the first communication port and the second communication port are positioned in the upper portion of the cleaner main body 15 (the main body portion 21). For example, the first communication port and the second communication port are positioned above the axis A of the main body connection port 26. The first communication port and the second communication port are open along a direction intersecting with the longitudinal direction of the cleaner main body 15 (the main body portion 21). The first communication port and the second communication port are positioned above the gravity center position G of the cleaner main body 15. The first communication port and the second communication port are disposed side by side in the forward-rearward direction. Further, the first communication port and the second communication port communicate with each other via the dust collecting unit 22 in a state where the dust collecting unit 22 is attached to the main body portion 21.

The exhaust port 33 is positioned in both side portions of the first main body portion 42. Accordingly, the exhaust port 33 is disposed near the front side of the cleaner main body 15. Accordingly, the exhaust port 33 is positioned in the vicinity of the main body connection port 26. The exhaust port 33 is positioned away from the main body connection port 26 and behind the main body connection port 26. Further, the exhaust port 33 is positioned in front of the gravity center position G of the cleaner main body 15. The exhaust port 33 may be covered with a filter (not illustrated).

An air duct is partitioned in the air duct body 16 illustrated in FIG. 3. The air duct body 16 communicates with the suction side of the electric blower 23 in a state of being connected to the cleaner main body 15. The air duct body 16 is provided with an elongated extension pipe 51. A suction port body may be provided on the tip side (an upstream side) of the air duct body 16. Any suction port body can be used as the suction port body. In the embodiment, a floor brush 52 is used as an example of the suction port body. The air duct body 16 is an optional configuration.

The extension pipe 51 is airtightly connected to the dust collecting unit 22 with the base end side of the extension pipe 51 connected to the cleaner main body 15. For example, the base end side of the extension pipe 51 is connected to the main body connection port 26. Accordingly, the extension pipe 51 is linearly positioned along the axis A of the main body connection port 26. The extension pipe 51 is detachably held by a clamp 54 provided in the cleaner main body 15 (the main body portion 21).

The floor brush 52 is provided with a case body 56. The floor brush 52 is provided with a connecting pipe 57. The case body 56 is laterally long. The case body 56 is formed in an elongated shape in the leftward-rightward direction. A suction port (not illustrated) is open in the lower portion of the case body 56 which faces a surface to be cleaned. The connecting pipe 57 is rotatably connected to the case body 56. Further, the connecting pipe 57 communicates with the suction port and is airtightly connected to the tip side of the extension pipe 51. The floor brush 52 is connected to the tip side of the extension pipe 51. For example, the connecting pipe 57 is inserted into and connected to the extension pipe 51 in the floor brush 52. In the floor brush 52, connection of the extension pipe 51 is retained by a floor brush clamp 59 provided in the extension pipe 51.

The Cleaner

A working of the embodiment will be described below.

In a case where the vacuum cleaner 11 is used as a handy cleaner (in the one use state), the cleaner main body 15 in which the dust collecting unit 22 is mounted on the main body portion 21 is used only. The vacuum cleaner 11 is used in a state where the air duct body 16 is removed from the cleaner main body 15. An air duct body such as a clearance nozzle (crevice nozzle) which is shorter than and different from the air duct body 16 provided with the extension pipe 51 and the floor brush 52, for example, may be connected to the main body connection port 26.

A user gripping the handle 27 performs operation setting by operating the setting button 28 of the vacuum cleaner 11. Then, the control device 24 drives the electric blower 23 in accordance with the operation setting. As a result, dust on a surface to be cleaned is suctioned with air by means of the negative pressure resulting from the driving of the electric blower 23 while the main body connection port 26 facing the surface to be cleaned or the air duct body connected to the main body connection port 26 is moved in the forward-rearward direction, an oblique direction etc. on the surface to be cleaned.

Once the handle 27 is gripped at this time, the posture in which the gravity center position G of the cleaner main body 15 is positioned directly below the hand of the user gripping the handle 27 is the posture in which the cleaner main body 15 can be most stably supported. In this regard, the gravity center position G of the cleaner main body 15 with respect to the position of the gripping hand remains substantially unchanged in a state in which any one region is gripped over the longitudinal direction of the handle 27, and thus the cleaner main body 15 almost constantly retains a stable posture and the tilting load of the cleaner main body 15 is difficult to be applied to the hand gripping the handle 27.

The dust-containing air is suctioned into the dust collecting unit 22 via the main body connection port 26 and the dust is separated from the air in the dust collecting unit 22. The dust-separated air is discharged from the dust collecting unit 22 to the main body portion 21 and suctioned into the electric blower 23. The electric blower 23 is cooled as a result. Subsequently, the air is discharged from the exhaust port 33 to the outside of the cleaner main body 15.

In a case where the vacuum cleaner 11 is used as a stick-type cleaner (in another use state), the air duct body 16 is connected to the cleaner main body 15 in which the dust collecting unit 22 is mounted on the main body portion 21. In this state, the floor brush 52 communicates with the dust collecting unit 22 via the extension pipe 51, the main body connection port 26 of the cleaner main body 15, and the first communication port and communicates with the suction side of the electric blower 23 via the dust collecting unit 22 and the second communication port of the cleaner main body 15.

A user gripping the handle 27 places the floor brush 52 of the vacuum cleaner 11 on a surface to be cleaned and performs operation setting by operating the setting button 28 of the handle 27. Then, the control device 24 drives the electric blower 23 in accordance with the operation setting. As a result, the floor brush 52 alternately travels in the forward-rearward direction, an oblique direction etc. on the surface to be cleaned. At the same time, dust on the surface to be cleaned is suctioned with air from the suction port of the floor brush 52 by means of the negative pressure resulting from the driving of the electric blower 23.

The suctioned dust-containing air is moved from the floor brush 52 to the cleaner main body 15 (the main body portion 21) via the extension pipe 51. Then, the dust is separated from the air and collected in the dust collecting unit 22 as in the case of the one use state described above.

Once the cleaning is completed, the user stops the electric blower 23 with the control device 24 by operating the setting button 28.

According to the embodiment described above, the handle 27 is shaped such that the gravity center position G of the cleaner main body 15 in the predetermined use state (the one use state described above) remains substantially unchanged in a state in which any one region is gripped. Accordingly, the cleaner main body 15 maintains a substantially constant posture and is difficult to tilt even in the event of a change in the gripping position of the handle 27, for example. As a result, it is possible to ensure operability in a state where the handle 27 is gripped.

Specifically, the handle 27 is formed approximately along the arc C which is centered at the gravity center position G of the cleaner main body 15 substantially, and thus the handle 27 can be easily formed such that the gravity center position G of the cleaner main body 15 in the predetermined use state remains substantially unchanged in a state in which any one region is gripped.

The electric blower 23 is disposed such that the gravity center position of the electric blower 23 substantially coincides with the gravity center position G of the cleaner main body 15. Accordingly, the moment of the force applied to the gravity center position G by the weight of the electric blower 23 can be close to zero when the handle 27 is gripped and operated. Accordingly, it is possible to enhance operability more in a state where the handle 27 is gripped.

Further, the secondary battery 25 and the dust collecting unit 22, which are the heaviest objects in the cleaner main body 15, are disposed on both front and rear sides across the gravity center position G of the cleaner main body 15. As a result, the cleaner main body 15 can be balanced with ease in terms of weight.

The handle 27 is provided at a position interconnecting the secondary battery 25 and the dust collecting unit 22 which are the heaviest objects in the cleaner main body 15. As a result, it is possible to easily set the position of the handle 27 where the gravity center position G of the cleaner main body 15 in the predetermined use state (in the one use state) remains substantially unchanged with respect to the gravity center position G set at a position between the dust collecting unit 22 and the secondary battery 25.

Further, the electric blower 23 is disposed between the secondary battery 25 and the dust collecting unit 22, which are the heaviest objects in the cleaner main body 15. As a result, the electric blower 23, the dust collecting unit 22, and the secondary battery 25 can be disposed both compactly and efficiently with the gravity center position G set at a position between the dust collecting unit 22 and the secondary battery 25.

The dust collecting unit 22 is disposed on the front side of the cleaner main body 15 and the secondary battery 25 is disposed on the rear side of the cleaner main body. As a result, the gravity center position G can be easily set in the substantially middle portion of the cleaner main body 15 in the forward-rearward direction (the longitudinal direction).

In the embodiment described above, the shape of the handle 27 can also be formed along an ellipse or a spline curve close to a circle, for example, insofar as the shape of the handle 27 can be substantially arcuate. Accordingly, the shape of the handle 27, in which the gravity center position G of the cleaner main body 15 in the use state remains substantially unchanged in a state in which any one region is gripped, can be any shape not limited to an arc.

In the above description, the vacuum cleaner 11 is used as a suction cleaner collecting dust in the dust collecting unit 22 by using the suction force of the electric blower 23. In an alternative example, the vacuum cleaner 11 can be used as a blower blowing dust by using the exhaust wind of the electric blower 23.

In the above description, the vacuum cleaner 11 is a cordless vacuum cleaner incorporating the secondary battery 25 as a power supply. Alternatively, the vacuum cleaner 11 may be a wired vacuum cleaner to which electric power is supplied from an external power supply such as a commercial AC power supply. In other words, the power supply unit is not limited to the battery (secondary battery 25) and a power supply unit as a heavy object such as a cord reel device can be used as the power supply unit.

While embodiments have been described, the embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The claims and their equivalents are intended to cover such forms or modifications as would fall within the scope and spirit of the invention.

DESCRIPTION OF REFERENCE SIGNS

11 VACUUM CLEANER
15 CLEANER MAIN BODY
22 DUST COLLECTING UNIT
23 ELECTRIC BLOWER
25 SECONDARY BATTERY (POWER SUPPLY UNIT)
27 HANDLE
G GRAVITY CENTER POSITION

What is claimed is:

1. A vacuum cleaner, comprising:
a cleaner main body; and
an electric blower, wherein
the cleaner main body includes:
a handle;
a dust collecting unit which communicates with a suction side of the electric blower and collects suctioned dust; and
a power supply unit which supplies electric power to the electric blower,
the dust collecting unit and the power supply unit are disposed on both sides which sandwich a gravity center position of the cleaner main body,
a part of the dust collecting unit is positioned on a virtual line connecting a substantially central portion of the power supply unit and the gravity center position of the cleaner main body when seen from a side direction, and
the handle is formed in a shape extending approximately along an arc which is centered at the gravity center position of the cleaner main body substantially such that the gravity center position of the cleaner main body under use remains substantially unchanged in a state in which any one region of the handle is gripped.

2. The vacuum cleaner according to claim 1, wherein the electric blower is disposed such that a gravity center position of the electric blower substantially coincides with the gravity center position of the cleaner main body.

3. The vacuum cleaner according to claim 1, wherein the handle is provided at a position which connects the dust collecting unit and the power supply unit of the cleaner main body.

4. The vacuum cleaner according to claim 1, wherein the electric blower is disposed between the dust collecting unit and the power supply unit.

5. The vacuum cleaner according to claim 1, wherein
the dust collecting unit is disposed on a front side of the cleaner main body, and
the power supply unit is disposed on a rear side of the cleaner main body.

6. The vacuum cleaner according to claim 1, wherein
the cleaner main body includes a main body connection port which communicates with the suction side of the electric blower, and
the gravity center position of the cleaner main body and the power supply unit are disposed on the same side with respect to an axial line of the main body connection port, when seen from the side direction.

* * * * *